US008833595B2

(12) United States Patent
Raballo

(10) Patent No.: US 8,833,595 B2
(45) Date of Patent: Sep. 16, 2014

(54) PACKAGE FOR FOOD PRODUCTS

(75) Inventor: Mauro Raballo, Alba (IT)

(73) Assignee: Soremartec S.A., Findel (LU)

( * ) Notice: Subject to any disclaimer, the term of this patent is extended or adjusted under 35 U.S.C. 154(b) by 0 days.

(21) Appl. No.: 13/377,306

(22) PCT Filed: Jun. 9, 2010

(86) PCT No.: PCT/IB2010/052560

§ 371 (c)(1),
(2), (4) Date: Dec. 9, 2011

(87) PCT Pub. No.: WO2010/143143

PCT Pub. Date: Dec. 16, 2010

(65) Prior Publication Data

US 2012/0074000 A1 Mar. 29, 2012

(30) Foreign Application Priority Data

Jun. 11, 2009 (IT) ..... TO2009A0447

(51) Int. Cl.

| | |
|---|---|
| ***A47G 19/06*** | (2006.01) |
| ***A45C 11/20*** | (2006.01) |
| ***B65D 1/24*** | (2006.01) |
| ***B65D 1/36*** | (2006.01) |
| ***B65D 81/32*** | (2006.01) |
| ***B65D 77/24*** | (2006.01) |

(52) U.S. Cl.

CPC ..... *B65D 77/245* (2013.01)
USPC ..... 220/574.1; 220/359.3; 220/212; 220/735; 220/678; 220/626; 220/556; 426/115; 206/541; 229/401; 30/124; D9/717

(58) Field of Classification Search

USPC ..... 220/212, 574, 574.1, 521, 735, 678, 220/626, 556, 62.11–62.22, 359.1–359.3; 426/115; 206/216, 541; 215/228; 229/401; 30/124; D9/717

See application file for complete search history.

(56) References Cited

U.S. PATENT DOCUMENTS 3,679,093 A * 7/1972 Chang ..... 220/574
3,997,676 A * 12/1976 Ando ..... 426/113

(Continued)

FOREIGN PATENT DOCUMENTS

AU 466274 11/1973
DE 6919524 10/1969

(Continued)

*Primary Examiner* — Fenn Mathew
*Assistant Examiner* — Jennifer Castriotta
(74) *Attorney, Agent, or Firm* — Rothwell, Figg, Ernst & Manbeck, P.C.

(57) ABSTRACT

A package for food products, including a cup (2) adapted to contain a food substance and a sealing member (6) applied to the mouth profile of the cup and in combination a take-up member (12) for taking up the food substance, such as a spatula or the like. The base wall (8) of the cup (2) has a depression (10) wherein the eating member (12) is housed and wherein the package includes a laminar member (14) applied to cover the depression (10) and the eating member (12); preferably, the laminar member (14) has on its face facing toward the eating member (12) a peripheral region (20) having an adhesive, which allows its fastening by adhesion to at least a portion of the wall of the cup (2) adjacent to the depression (10) and an internal non-adhesive region (16) overlying the eating member.

8 Claims, 2 Drawing Sheets

(56) References Cited

U.S. PATENT DOCUMENTS

| | | | | |
|---|---|---|---|---|
| 4,811,846 | A * | 3/1989 | Bottega | 206/542 |
| 5,705,212 | A * | 1/1998 | Atkinson | 426/115 |
| 6,003,710 | A * | 12/1999 | Huang | 220/212 |
| 6,840,395 | B2 * | 1/2005 | Agarwal et al. | 220/556 |
| 7,017,774 | B2 * | 3/2006 | Haedt | 220/735 |
| 2001/0033882 | A1 | 10/2001 | Liu | |
| 2003/0029868 | A1 * | 2/2003 | Davidov et al. | 220/212 |
| 2007/0023436 | A1 * | 2/2007 | Sierra-Gomez et al. | 220/359.2 |

FOREIGN PATENT DOCUMENTS

| | | | |
|---|---|---|---|
| DE | 202004012669 | U1 | 12/2005 |
| DE | 202004012432 | U1 | 1/2006 |
| EP | 0768039 | B1 | 9/2000 |
| GB | 2364043 | A | 1/2002 |

* cited by examiner

PACKAGE FOR FOOD PRODUCTS

CROSS REFERENCE TO RELATED APPLICATION(S)

This application is a 35 U.S.C. §371 National Phase Entry Application from PCT/IB2010/052560, filed Jun. 9, 2010, designating the United States and also claims the benefit of Italian Application No. TO2009A000447, filed Jun. 11, 2009, the disclosures of which are incorporated herein in their entirety by reference.

The present invention relates to a package for food products, of the type that comprises a cup adapted to contain a food substance, provided with a sealing member and also including in combination a take-up member for taking up said food substance, such as a spatula or the like.

EP 0 768 039 A, filed by the applicant, discloses a package of the type indicated above made up of two plastic half-shells, in which one of the half-shells contains a food substance and is sealed with a cover by way of a membrane attached to the rim at the opening of the first half-shell and the other half-shell contains an accessory or optionally a take-up member such as a spatula; in one embodiment the spatula for taking up the food substance may form an integral part of the membrane cover. The spatula is therefore protected against contact with the exterior by the second half-shell. That package has a drawback which occurs in the sales experience of the applicant, in that the eating member or spatula, being located inside the package, is not immediately noticed by the consumer, who often supplies his or her own spoon.

It is an object of the invention to provide a package that includes a take-up member for taking up the food substance contained therein, said member being located on the outside of the package but without increasing the overall size of the package, so that it is visible at the time of the purchase of the package, in which said eating member is made easily accessible to the consumer and at the same time properly protected from contact with the external environment, and in which the structure of the package can also be produced at low cost, so that the package is particularly suitable for mass production.

For this purpose, the subject of the invention is a package having the features defined in the claims which follow.

Other features and advantages of the package according to the invention will be made obvious in the following detailed description, which refers to the appended drawings, supplied purely by way of non-restrictive example, in which.

Figure 1:
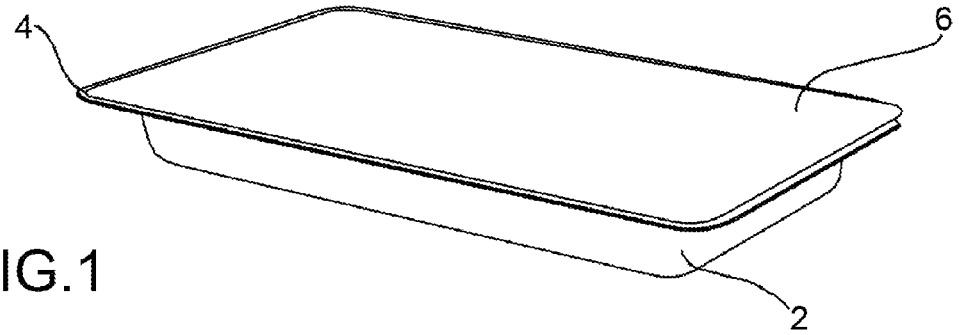
FIG. 1 is a perspective view of a package according to the invention.
Figure 5:
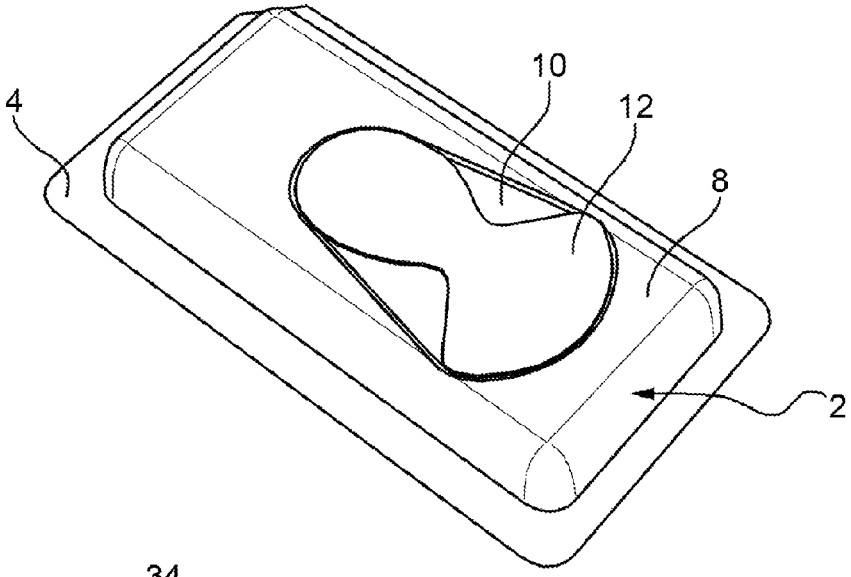
FIG. 5 is a perspective view of the package in a configuration similar to that illustrated in FIG. 2, where the package is without the aforementioned laminar cover member.

Referring to the drawings, a package according to the invention comprises a cup 2, or similar containment body, typically of plastic suitable for food contact, manufactured by thermoforming or injection moulding. The cup 2 has, in a manner known per se, a flange 4 which runs around the rim of the opening of the cup, and a sealing sheet 6 or similar closing member is welded to its outer surface.

The cup 2 has a flat, or at least partly flat, base wall 8 which, in the configuration of normal use, the package rests on. This wall 8 has a depression or recess 10 housing a take-up member 12 such as a spatula or the like. The eating member 12 preferably has a flattened body, preferably of uniform thickness.

The depression 10 preferably has a uniform depth throughout its area so that when the eating member 12 is inserted in the depression, its outermost surface is preferably flush with the portions of the base wall 8 which are adjacent to the depression 10.

The depression 10 and the eating member 12 are preferably shaped in such a way that the outline of the depression exhibits one or more separate sections which by their shape fit one or more sections of the outline of the eating member; the depression is preferably shaped in such a way that the eating member can be placed in the depression without freedom of movement. Clearly, it is possible to arrange for the entire length of the outline of the depression 10 to be essentially complementary to the outline of the eating member.

Reference number 14 denotes a laminar member in the form of a label that is applied by adhesion to the wall 8 of the cup, to cover the depression 10 and the eating member 12 inside it.

Figure 3:
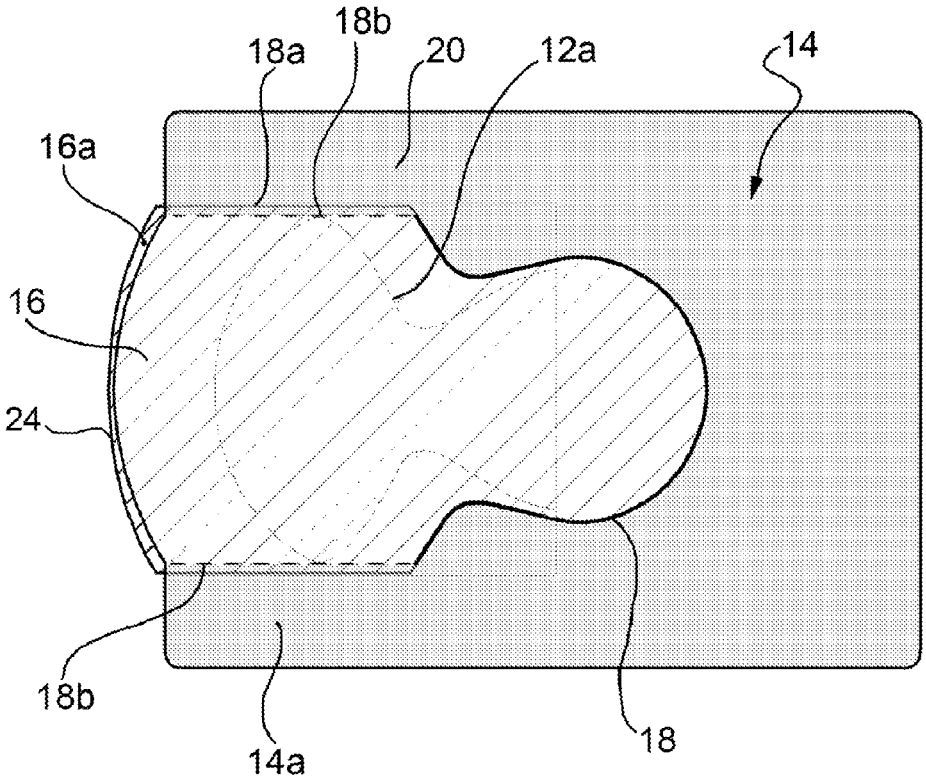
FIG. 3 is a top view of a laminar cover member which is part of the package.

The abovementioned laminar member 14 is illustrated separately from the package in FIG. 3. It comprises, on its face which in the package is next to the eating member, a preferably non-adhesive internal central region 16 with an outline 18 shaped so as to totally cover the outermost surface of the eating member 12 and a peripheral region 20 which surrounds the abovementioned central region which is provided with adhesive.

In FIG. 3 the central internal region 16 is also indicated by diagonal lines and in this figure a solid line 12*a* denotes the outline of the eating member 12.

The laminar cover member 14 has a weakened line 18*a* whose outline coincides with or runs parallel to the outline 18 of the non-adhesive internal region 16.

In the preferred embodiment the laminar member 14 is a lamination comprising a first film 14*a* having an adhesive, preferably totally adhesive, face which is provided with a weakened line 18*b*, the outline of which corresponds essentially to the outline of the internal region 16 and a non-adhesive film 16*a* shaped to match the shape of the internal region 16 and laminated to the first film along said weakened outline; the weakened outline 18*b* may be a line of ready-made incisions or a mixed line of ready-made incisions and solid lines, in which a slight cut has been made so that the line constitutes a preferred tear line.

Figure 4:
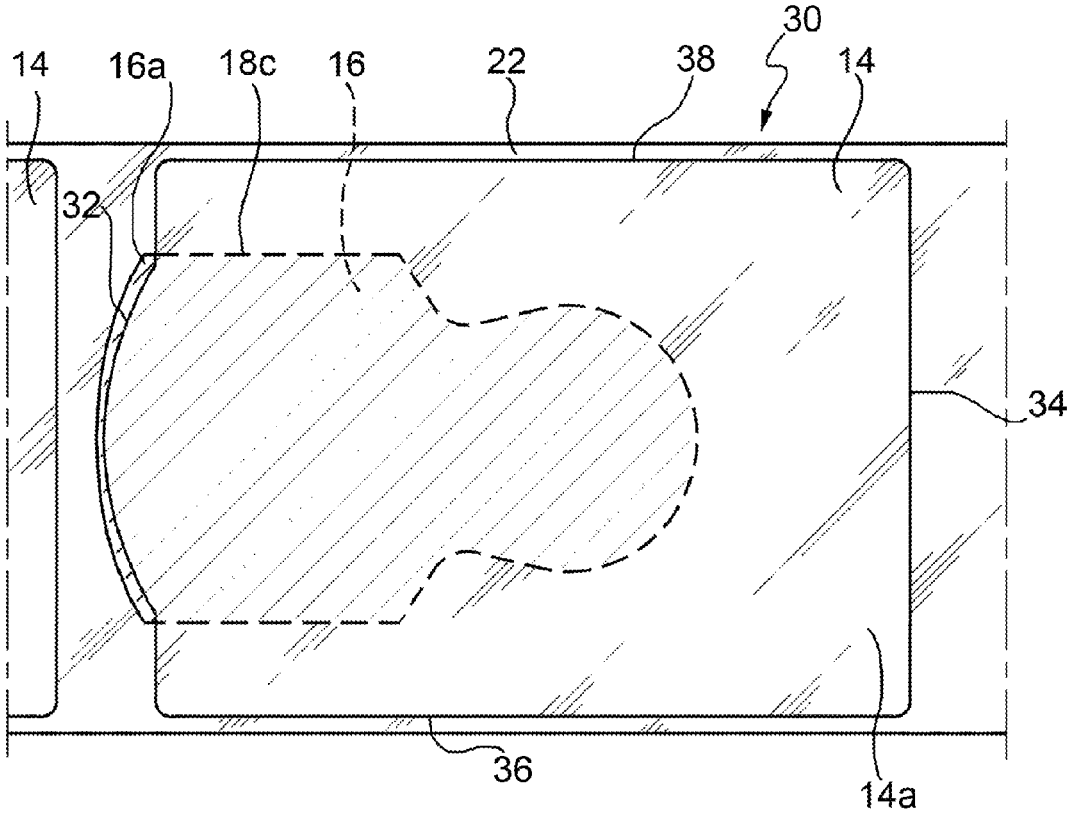
FIG. 4 is a portion of a tape from which the laminar cover member seen in FIG. 3 can be taken.

In this embodiment the laminar member 14 can be obtained from a continuous tape such as that illustrated in FIG. 4.

FIG. 4 shows a portion of a continuous tape 30 that comprises a continuous plastic backing tape 22 and which has, on its surface shown as being on top in FIG. 4, a plurality of separate and consecutive adhesive sheets or adhesive labels, each with an outline corresponding to the outline of each film 14*a* of the laminar members 14.

The tape 30 itself is made from a two-layer tape produced by bringing together a first continuous backing tape 22 (preferably transparent) and a second continuous tape (for which only the portions 14 can be seen in FIG. 4). The second tape is superimposed on the backing tape 22 and its face adjacent to the backing tape 22 is coated with adhesive.

This laminated tape 30 is precut with a closed incision outline 18*c* shaped to give an outline corresponding to the outline of the film 16*a*. The operation of precutting the laminated tape 30 is performed by cutting the backing tape 22 to this incision outline and preferably at the same time generating a weakened line in the adhesive tape superimposed on top of it, to the same outline.

Then, in a second operation of punching or blanking, the superimposed adhesive tape is cut to a closed incision outline 32, 34, 36, 38 that defines the perimeter of each film 14*a* of the laminar member or label 14. Simultaneously, or subsequently, the weakened lines 18*b* are created on the film 14*a*, preferably with pre-cut incisions, that coincide with or run parallel to and a short distance away from the corresponding outline of the film 16*a*.

The waste parts of the laminated tape lying around each film 14*a* are then removed from the laminated tape to obtain the tape shown in FIG. 4. Removal of each adhesive film 14*a* from the backing tape 22 means that this film 14*a* remains stuck to the non-adhesive film 16*a* generated on the backing tape 22. The laminar member or label 14 formed by the lamination of the film 14*a* and the film 16*a* is thus obtained.

The laminar member or label 14, after being removed from the backing tape, is applied so that the peripheral region 20 is stuck to the wall 8 of the cup 2 and the non-adhesive internal region is over the eating member 12, so ensuring the hygiene of the eating member (designed to be put in the consumer's mouth), which does not come into contact with the adhesive material present on the adjacent surface of the film 14 because the latter is covered by the pre-incised part 16*a* of the non-adhesive tape 22. To remove the eating member 12, the consumer holds the outer edge 24, which is not stuck to the base wall 8 of the cup, and tears along the weakened lines 18*a* and/or 18*b* so as to remove all or part of the internal central region 16 of the laminar member or label 14, to which the film 16*a* remains stuck.

Typically, the internal central region 16 of the laminar member or label 14 extends over the wall 8 not only to cover the eating member 12 and depression 10 but also a portion of the wall 8 adjacent to the outline of said depression: in this way the eating member is protected from contact with the environment.

Figure 2:
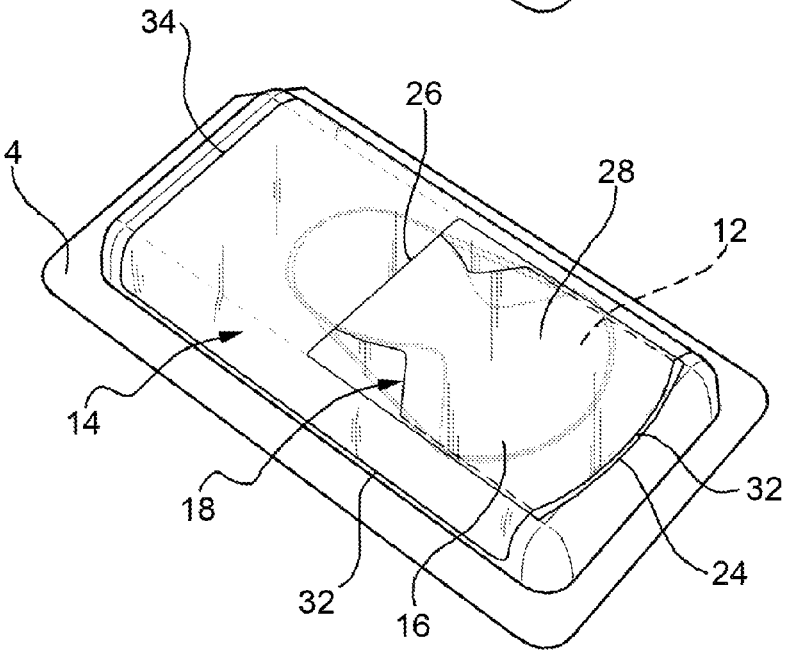
FIG. 2 is a perspective view of the package seen in FIG. 1 in the inverted configuration, so as to make the base wall of the package visible.

The laminar member 14 may be made of transparent or non-transparent plastic: preferably, this laminar member has at least one transparent region which, in FIG. 2, is defined by the peripheral line 26 so as to define a window 28 allowing the consumer to see part or all of the surface of the eating member 12. That region or those regions of the laminar member 14 which is or are adjacent to the window 28 may be of non-transparent plastic and have printed writing and information about the nature of the product contained in the package.

The invention thus makes available a package, the manufacture of which on an industrial scale is inexpensive and highly advantageous in that it makes it possible to attach to the package itself a take-up member contained within the overall dimensions of the package in a protected manner and in such a way as to be easily visible and easily removable by the consumer.

Clearly, without altering the principle of the invention, the embodiments and details of construction may depart considerably from those described and illustrated by way of example without departing from the scope of the claims which follow.

In particular, it is intended that the features of the shape of the cup may differ from those described and illustrated by way of example. Similarly, the shape of the depression and the shape of the eating member may be varied, although the invention is particularly advantageous in relation to the use of a take-up member in the form of a flat spatula of essentially constant thickness.

The invention claimed is:

1. A package for food products, comprising a cup adapted to contain a food substance and a sealing member applied to a rim of an opening of said cup and in combination a take-up member for taking up said food substance, such as a spatula, wherein a base wall of the cup has a depression wherein said take-up member is housed characterised in that said package comprises a laminar member applied to cover said depression and said take-up member and wherein said laminar member comprises a first film having an adhesive face comprising an adhesive peripheral region for attachment by adhesion to at least a portion of the base wall of the cup adjacent to said depression and an internal adhesive region facing said take-up member, said first film being provided with a weakened profile defining said internal region, and a second film which is not adhesive and shaped to match the shape of said internal region and coupled to said first film along said weakened profile, wherein said second film is positioned between said take-up member and said first film.

2. A package for food products, according to claim 1, characterised in that said peripheral region and said internal region are adjacent one to the other along said weakened profile which is susceptible to be torn by the user to allow the extraction of said take-up member.

3. A package according to claim 1, characterised in that said take-up member has a flattened body with a substantially constant thickness.

4. A package according to claim 1, characterised in that said depression has a depth substantially corresponding to the thickness of said take-up member.

5. A package according to claim 1, characterised in that said depression has an outer profile at least partially complementary to the outer profile of said take-up member.

6. A package according to claim 1, characterised in that said weakened profile has at least a couple of segments, adjacent to a terminal end of the laminar member, with ready-made incisions.

7. A package according to claim 1, characterised in that said laminar member has, in its region overlying or partially overlying said take-up member, a transparent area.

8. A package according to claim 1, characterised in that said adhesive peripheral region of the laminar member is adhesively bonded to a portion of the base wall of the cup and to at least two side walls of the cup, which are adjacent to said base wall.

* * * * *